United States Patent [19]

Szafranski

[11] Patent Number: 5,005,854

[45] Date of Patent: Apr. 9, 1991

[54] ALPINE SAFETY SKI BINDING

[75] Inventor: Pierre Szafranski, Annecy Le Vieux, France

[73] Assignee: Salomon S.A., Annecy Cedex, France

[21] Appl. No.: 271,916

[22] Filed: Nov. 16, 1988

[30] Foreign Application Priority Data

Nov. 18, 1987 [FR] France ..... 87 16302

[51] Int. Cl.[5] ..... A63C 9/08

[52] U.S. Cl. ..... 280/626; 280/632

[58] Field of Search ..... 280/632, 631, 634, 626, 280/623

[56] References Cited

U.S. PATENT DOCUMENTS

| | | | |
|---|---|---|---|
| 4,183,549 | 1/1980 | Salomon | 280/632 |
| 4,681,338 | 7/1987 | Spitaler | 280/626 X |

FOREIGN PATENT DOCUMENTS

| | | | |
|---|---|---|---|
| 2243642 | 3/1973 | Fed. Rep. of Germany . | |
| 2838904 | 3/1980 | Fed. Rep. of Germany | 280/632 |
| 3128778 | 2/1983 | Fed. Rep. of Germany | 280/632 |
| 1485708 | 5/1967 | France . | |
| 2598928 | 11/1967 | France . | |
| 2598933 | 11/1967 | France . | |
| 1529161 | 5/1968 | France | 280/632 |
| 2338060 | 8/1977 | France . | |
| 2600901 | 1/1988 | France . | |

*Primary Examiner*—Charles A. Marmor
*Assistant Examiner*—Michael Mar
*Attorney, Agent, or Firm*—Sandler, Greenblum & Bernstein

[57] ABSTRACT

A safety ski binding, for retaining the end of a boot to a ski until a threshold bias force is exerted, includes a body for connection to the ski, and a jaw mounted on the front of the body for movement between a closed position at which the jaw is adapted to engage and retain the end of the boot to the ski, and an opened position at which the jaw is adapted to either free the end of the boot or to receive the end of the boot into the binding. Elastic return apparatus is provided for the purpose of resiliently maintaining the jaw in either its closed or opened position. A manually operable lever having a handle is mounted on the body for movement between closed and opened positions. The handle and the jaw have first cooperable elements for moving the jaw to its opened position in response to movement of the handle from its closed to its opened position. The handle and jaw also have second cooperable elements for moving the jaw to its closed position in response to movement of the handle from its opened to its closed position. The second cooperable elements include a front edge on the handle engageable with a portion of the upper surface of the jaw.

23 Claims, 5 Drawing Sheets

ALPINE SAFETY SKI BINDING

DESCRIPTION BACKGROUND OF THE INVENTION

1. Field of the Invention

This invention relates to an alpine safety ski binding for retaining one end of a boot, preferably, but not necessarily, the rear end, to a ski until the boot is subjected to excessive bias.

2. Description of Background and Relevant Information

The present invention is concerned with bindings that comprise a body connected to a ski such that limited longitudinal displacement of the boot is possible, and to bindings in which limited pivotal movement of the boot about a transverse axis is possible. Such bindings are disclosed in French Patent No. 2,338,060 and in French Patent Application Nos. 86/07837 and 86/07838, the disclosures of which are hereby incorporated by reference. Each of these bindings comprises a jaw movable on a body adapted to retain the end of a boot to a ski, and to free the boot when binding forces applied to the boot exceed a predetermined threshold. For a rear binding, the jaw is movable, generally, in a vertical plane.

The bindings also include a lever operatively connected to the jaw for effecting a user initiated opening of the jaw' 5 e.g., in order for the user to voluntarily disengage the end of his boot from the jaw. To this end, the lever is equipped with means cooperating with the jaw to effect its voluntarily opening.

Such apparatus is particularly described in French Patent No. 2,338,060 issued to the assignee of the present application, as well as in French Patent No. 1,485,708, the disclosures of both of which are hereby incorporated by reference.

In these two last mentioned patents, the operable lever by which removal of the boot from the jaw is effected is mounted for pivotal movement about an axis carried by a pressure element that functions as elastic return means for the jaw. In the '060 patent, the pressure element is a spring-loaded longitudinal sliding piston. In the second patent, a pivotal rocker is compressed by a spring against a ramp carried by the jaw.

It is further known to equip the boot remover lever with means by which manipulation of the lever effects manual closure of the jaw. This is particularly advantageous when the skier seeks to reinsert the boot into the binding under difficult conditions, particularly in powdery snow, i.e., in a situation where the ski rests on a unstable support which does not sufficiently resist a downward force that the skier would give his foot in order to engage the binding and close the jaw thereof.

In some bindings sold since 1981 by the assignee of the present application, for example, those sold under the designation "737" and "747", the lever-operated means which permit manual closing of the jaw are constituted by hooks which cooperate with ramps situated within lateral cheeks of the jaw. In such bindings, levers as well as the jaw present specific means for achieving the manual closure of the jaw by means of the lever, i.e., they have particular means that are added to the lever and to the jaw to assure lever-closure of the jaw.

It is therefore an object of the present invention to provide a new and improved alpine safety ski binding which is simpler in construction and more easily operated by the user as compared to the known prior art.

SUMMARY OF THE INVENTION

According to the present invention, a ski safety binding for retaining the end of a boot to a ski until a threshold bias force is exerted includes a body for connection to the ski. A jaw is mounted on the front of the body for movement between a closed position at which the jaw is adapted to engage and retain the end of the boot to the ski, and an opened position at which the jaw is adapted either to free the end of the boot or to receive the end of the boot into the binding. Elastic return apparatus are provided which are constructed and arranged so as to resiliently maintain the jaw in either its closed or its opened position. A manually operable lever having a handle is mounted on the body for movement between closed and opened positions. First cooperable means on the handle and the jaw are provided for moving the jaw to its opened position in response to movement of the handle from its closed to its opened position, and second cooperable means are provided on the handle and on the jaw for moving the jaw to its closed position in response to movement of the handle from its opened to its closed position. Specifically, the second cooperable means include a front edge on the handle cooperable with a portion of the upper surface of the jaw.

In a preferred construction, the front edge of the handle engages a portion of the upper surface of the jaw when the handle is in its opened position. Movement of the handle to its closed position directly imparts movement to the jaw by the interaction between the front edge and said portion of the upper surface of the jaw. In this manner, positive movement can be imparted to the jaw for moving the same from its opened to its closed position by reason of the movement of the handle from its opened to its closed position. Thus, the jaw can be closed by user-operation of the handle independently of pressure of the end of the boot on the jaw.

In one embodiment of the present invention, the front edge of the handle is established by a planar surface. The angularity of the planar surface relative to the horizontal may vary between 30°–45° when the handle is in its opened position. A particularly preferred angle for the surface is about 37°. The portion of the upper surface of the jaw engaged by the front edge of the handle may be planar or curved.

In another embodiment of the invention, the front edge of the handle defines a curved surface. This surface is preferably curved in a convex manner so that engagement between this surface and the upper portion of the jaw includes both sliding and pivotal movement. This reduces friction between the handle and the jaw and facilitates movement of the jaw to its closed position.

BRIEF DESCRIPTION OF THE DRAWINGS

Embodiments of the invention are shown in the accompanying drawings by way of non-limiting examples wherein.

DESCRIPTION OF PREFERRED EMBODIMENTS

Figure 1:
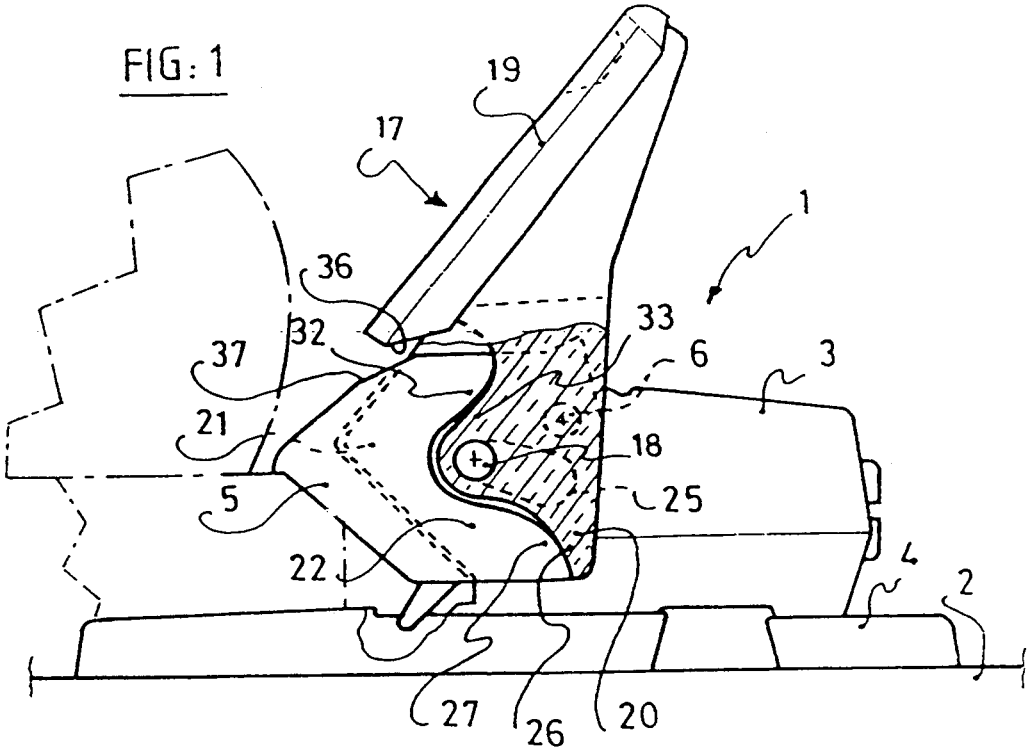
FIG. 1 is a side view of a rear binding according to a non-limiting embodiment of the present invention with parts broken away showing the jaw in closed position.

The ski safety binding for retaining the end of a boot to a ski until a threshold bias force is exerted includes a body for connection to the ski, and a jaw mounted on the front of the body for movement between a stable closed position at which the jaw is adapted to engage and retain the end of the boot resting against the ski, and a stable opened position where the jaw is adapted to either free the end of the boot from the binding or to receive said end into the binding. An elastic return apparatus is provided for biasing the jaw towards one or the other of its stable positions, the apparatus including energization means and a pressure element. The jaw includes a ramp comprising an elastic extent segment and an opening segment selectively engageable with the pressure element, engagement of the spring-biased pressure element with the elastic extent segment of the ramp effecting movement of the jaw toward its closed position, and engagement of the pressure with the opening segment of the ramp effecting movement of the jaw towards its open position. A lever has a handle pivotally mounted on the body for movement between a raised position rising above the body towards the rear thereof when the jaw is in its closed position, and an extended or lowered position when the jaw is in its opened position. The handle has a front end defined by a front edge and two parallel cheeks which overly the rear portion of the jaw.

First means on the lever are cooperable with first means on the jaw for opening the latter and second closure means on the lever are cooperable with second means on the jaw for closing the latter. The second means of the lever is constituted by at least one portion of the front edge of the handle and the second means of the jaw is constituted by at least a portion of the upper surface of the jaw. The second means of the lever and the second means of the jaw are constructed and arranged so that, when the jaw is in its opened position, and the lever is in its lowered position, the front edge of the lever engages a portion of the upper surface of the jaw, and movement of the lever towards its surface of the jaw, and movement of the lever towards its raised position causes the front edge of the lever to slide on the upper surface of the jaw while moving the latter toward its closed position, at least until the pressure element has reached the elastic extent segment.

Referring now to the drawings, reference numeral 1 designates a binding according to the present invention mounted on ski 2. Binding 1 comprises body 3 connected either directly to the ski, or by known longitudinal adjustment means and means which allow for the longitudinal displacement of slide 4.

Binding 1 also includes jaw 5 pivotally movable around transverse axis 6 constituted by a pin carried by body 3. The free end of jaw 5, in response to pivotal movement of the jaw on axis 6, is vertically displaceable against the force exerted by the return energy of an elastic return described below. Thus, jaw 5 is movable between a closed position shown in FIG. 1, and an opened position shown in FIG. 3. In its closed position, jaw 5 is adapted to engage and retain the end of the boot in support position against the ski; and in its opened position, jaw 5 is adapted to liberate the end of the boot. In the opened position of the jaw, as a result of either its voluntary or involuntary release, the end of the boot is removable from or insertable into the binding. Preferably, jaw 5 includes boot insertion pedal 7 engageable by the sole of the boot when the jaw is in its opened position. Downward pressure applied to the boot when it engages pedal 7 will pivot jaw 5 to its closed position.

Figure 2:
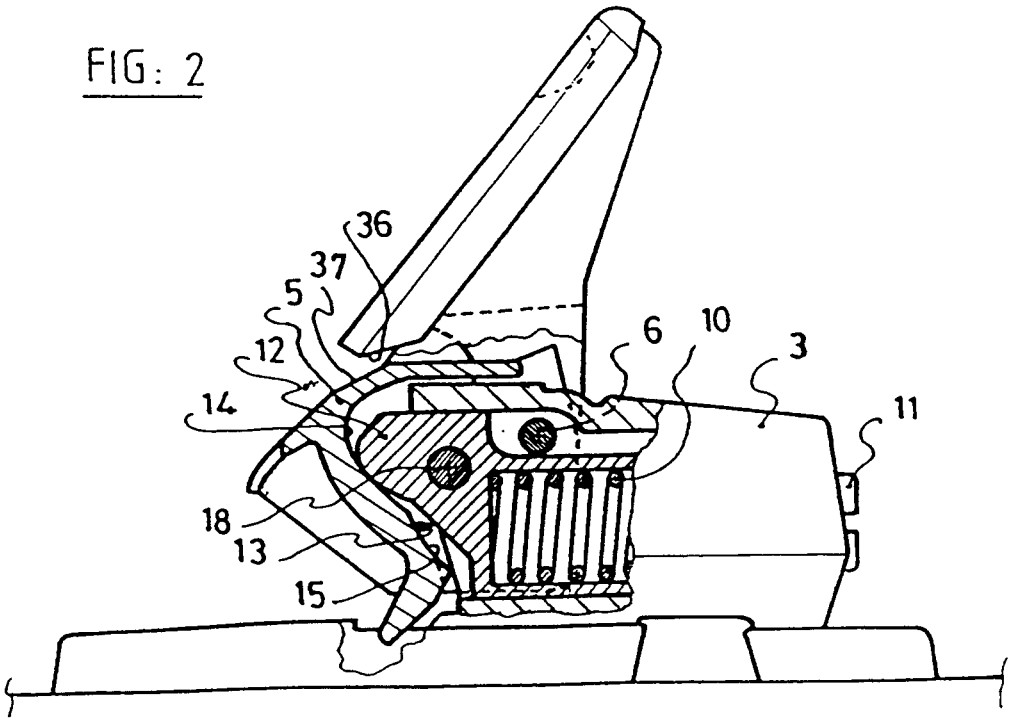
FIG. 2 is a side view, partially in cross-section, of the energization means of the binding shown in FIG. 1.

FIG. 2 shows details of one form of an elastic return apparatus for the jaw. This apparatus comprises an energization means, shown in the form of compression spring 10, one end of which engages rear adjustment screw 11 on the rear of body 3, and the other end of which engages a pressure element, shown in the form of piston 12, which is slidably guided in the body for movement in a substantial longitudinal direction. The forward free end of piston 12 is biased by spring 10 into engagement with ramp 13 on the jaw. Ramp 13 includes two portions: elastic extend segment 14 which, in cooperation with piston 12, effects elastic return of jaw 5 in the direction toward its closed position shown in FIG. 1; and opening segment 15 which, in cooperation with piston 12, effects elastic return of jaw 5 in the direction toward its opened position shown in FIG. 3. Other elastic return apparatus may be used, however; and by way of illustration, two other elastic return apparatus are described in connection with FIGS. 6 and 7.

Figure 8:
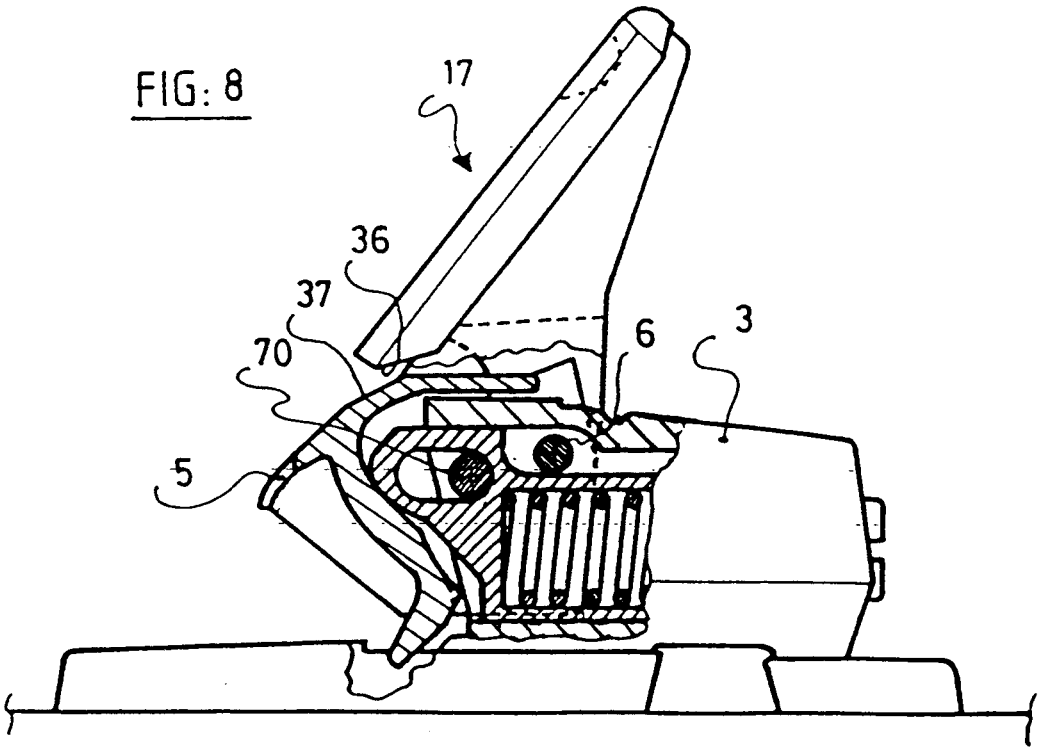
FIG. 8 is an alternative embodiment of the present invention with respect to the journal axis of the lever.

The binding shown in FIG. 1 also includes lever 17 pivotally movable around transverse axis 18 carried by the movable pressure element, i.e., piston 12, in the vertical longitudinal plane of the ski. Other pivotal connections of the lever may be used, however. In particular, the lever could be journalled about a fixed axis mounted on body 3. Alternatively, the lever could be journalled around a fictional axis. FIG. 8, as described below, illustrates an alternative embodiment in which lever 17 is mounted for pivotal movement around transverse axis 70 mounted directly on body 3.

Lever 17 includes handle 19 which, in its closed position, rises upwardly and towards the rear of body 3 when jaw 5 is in its closed position as shown in FIG. 1. In the opened position of jaw 5, shown in FIG. 3, handle 19 is in its opened position overlying body 3 and extending to the rear. Lever 17 is U-shaped and includes two vertically disposed and parallel side cheeks 20 and 21 which extend to form handle 19 in the direction of the body, and which are positioned in a manner so as to overlie the lateral sides of body 3. It is cheeks 20 and 21 which carry a pin defining rotation axis 18 of lever 17.

Figure 9:
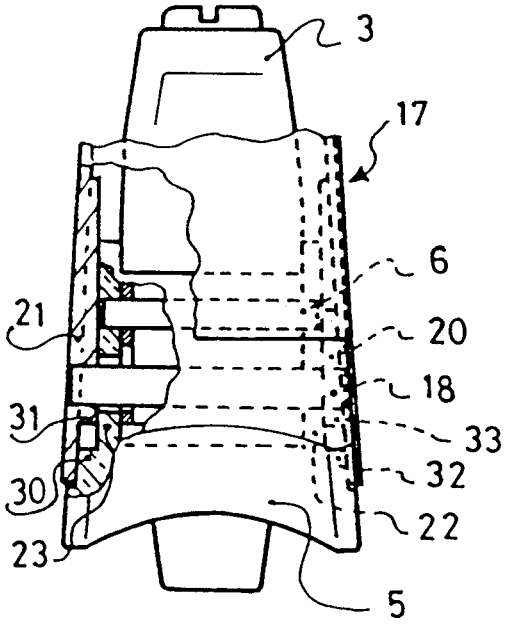
FIG. 9 is a top view, in partial cross-section, of the binding of FIG. 1, with the purpose of illustrating the relative position of the jaw and lever.

Cheeks 20 and 21 of lever 17 are nested against and overlie the lateral cheeks 22 and 23 of jaw 5. Only cheek 22 of the jaw is shown in FIG. 1. FIG. 9 illustrates the relationship between jaw 5 and lever 17. The relationship is such that cheeks 20 and 21 are positioned exterior to and respectively engaged with cheeks 22 and 23 of the jaw. To accommodate relative movement of the jaw and the lever required by the engagement of piston 12 with segments 14 and 15 of the jaw, each lateral side face 22, 23 of the jaw has a slot 25 through which the pin defining axis 18 of the lever extends. The shape of the slot takes into account the different movements of jaw 5, lever 17, and pressure element 12. It is generally dimensioned in a manner such that, during the different movements of the jaw, the pin defining axis 18 can freely move within slot 25.

Cheeks 20 and 21 of lever 17 include first means that cooperate with complementary first means of the jaw. These first means of the lever and of the jaw cooperate in response to user-movement of the handle of lever 17 from the position shown in FIG. 1 to the position shown in FIG. 3, jaw 5 moves to its opened position.

As shown in FIG. 1, the first means of lever 17 are constituted by a cam shown as ramp 26 on the inside of each of the cheeks of the lever, the ramp cooperating with pressure noses 27 on the jaw. Preferably, as shown in FIG. 9, the lateral cheeks 20 and 21 of lever 17 have shoulders 30, 32 which face shoulders 31, 33 on the lower portion of jaw 5 and which define pressure noses 27 on the jaw.

The pressure nose 27 on the jaw is elastically biased into contact with ramp 26 by the elastic return apparatus of the jaw. Furthermore, ramp 26 has a shape such that the movement of lever 17, from the position shown in FIG. 1 to the position shown in FIG. 3, causes pressure nose 27 to engage and slide on ramp 26 imparting rotation to jaw 5 around its axis 6. In a known manner, as soon as the nose of pressure element 12 engages opening segment 15 on the jaw, the latter will tend to pivot towards its opened position in response to the action of spring 10 against element 12 and the presence of slot 25 in the jaw.

Lever 17 furthermore has second means that cooperate with complementary second means on the jaw for closing the same. The second means are such that movement of the lever from the position which it occupies in FIG. 3 to the position it occupies in FIG. 1 causes the jaw to move towards its closed position. Thus, lever 17 makes it possible to achieve both the voluntary closure and opening of the jaw.

As shown in FIG. 1, the second means of lever 17 are constituted by a portion of front edge 36 of handle 19 which overlies the jaw. The complementary second means of the jaw is constituted by at least a portion of upper surface 37 of the jaw situated under front edge 36 of handle 19. By reason of the relative position of the axes of rotation of the jaw and of the lever, front edge 36 of lever 17 and upper surface 37 of the jaw are positioned with respect to one another. That is to say, in the opened position of the jaw which corresponds to the lower position of the lever shown in FIG. 3, front edge 36 engages upper surface 27 on the jaw. In this manner, movement of the lever 17, from the position it occupies in FIG. 3 to the position it occupies in FIG. 1, causes rotation of front edge 36 on the lever. By reason of its engagement with the upper surface 37 of the jaw, front edge 36 imparts pivotal movement to jaw 5 towards its closed position, at least until the nose of pressure element 12 engages elastic extent segment 14. In this zone, the jaw is biased by the elastic return apparatus towards its closed position.

Figure 4:
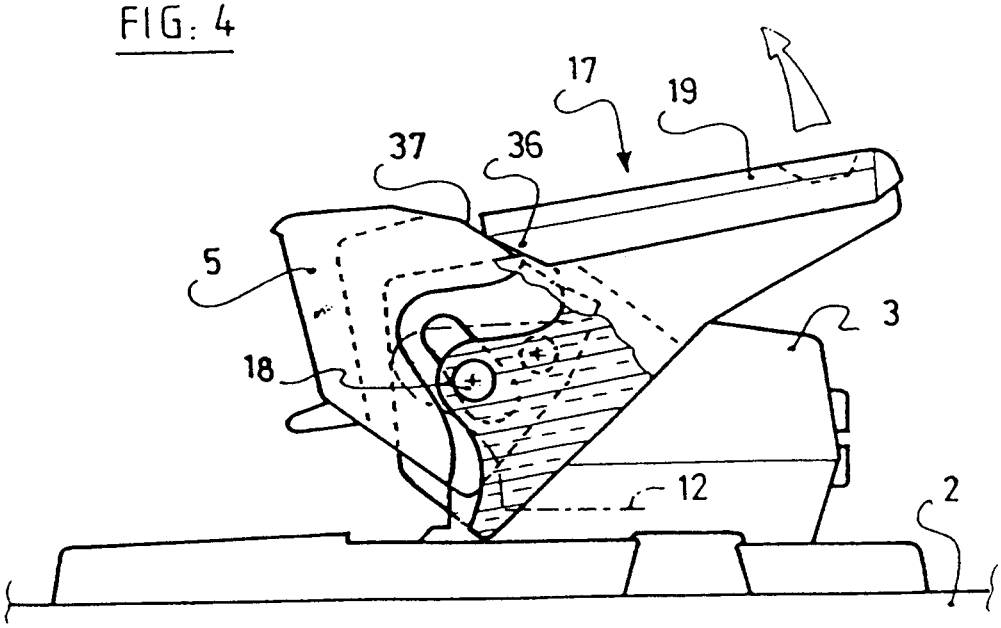
FIG. 4 is a side view similar to that of FIG. 3, but showing the jaw being moved by the lever towards its closed position.

FIG. 4 shows an intermediate position of the lever in which front edge 36 of lever 17 is engaged with upper surface 37 of the jaw. As the lever is moved counterclockwise as seen in FIG. 4, the jaw is moved by the lever because of the force exerted by front edge 36 of the lever on the upper surface of the jaw. Such movement occurs when the user manipulates the lever in the direction of the arrow shown in FIG. 4 in order to close the jaw.

Figure 3:
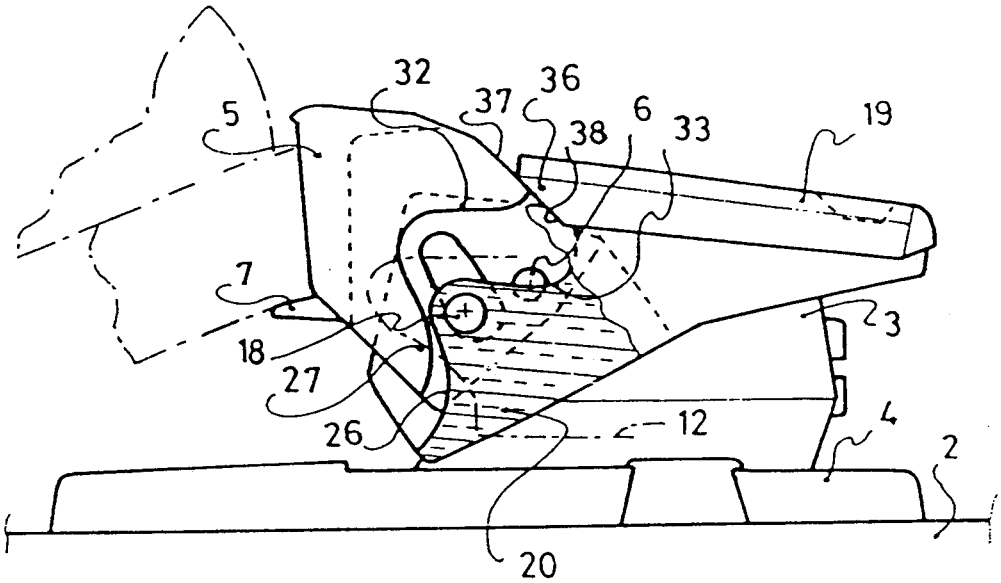
FIG. 3 is a side view of the binding shown if FIG. 1, but with the jaw shown in open position.

On the other hand, the user may achieve closure of the binding by direct action of the jaw, for example, by using the boot insertion pedal 7. In this case, the application of downward pressure on pedal 7 as shown in FIG. 3 imparts counterclockwise movement to pressure nose 27 of the jaw which engages cam 26 of lever 17 and pivot s it in a counterclockwise direction. As a result, closure of the jaw causes, in parallel fashion, upward pivotal movement of the lever and the various elements of the binding assume the positions shown in FIG. 1.

Preferably, front edge 36 of handle 19 has a beveled edge 38 which is oriented such that, in the position shown in FIG. 3, the edge is parallel to the upper surface 37 of jaw 5. Upper surface 37 of the jaw is oriented with respect to rotational axis 6 of the jaw such that the force, resulting from the engagement of the beveled edge of upper surface 37 on the jaw, causes pivotal movement of the jaw in the direction of its closure.

In a preferred embodiment of the invention, the beveled edge 38 of the front edge 36 makes an angle of between 30°–45° with the horizontal while the lever is in its opened position (FIG. 3). Good results have also been obtained with an angle of about 37°.

Figure 5:
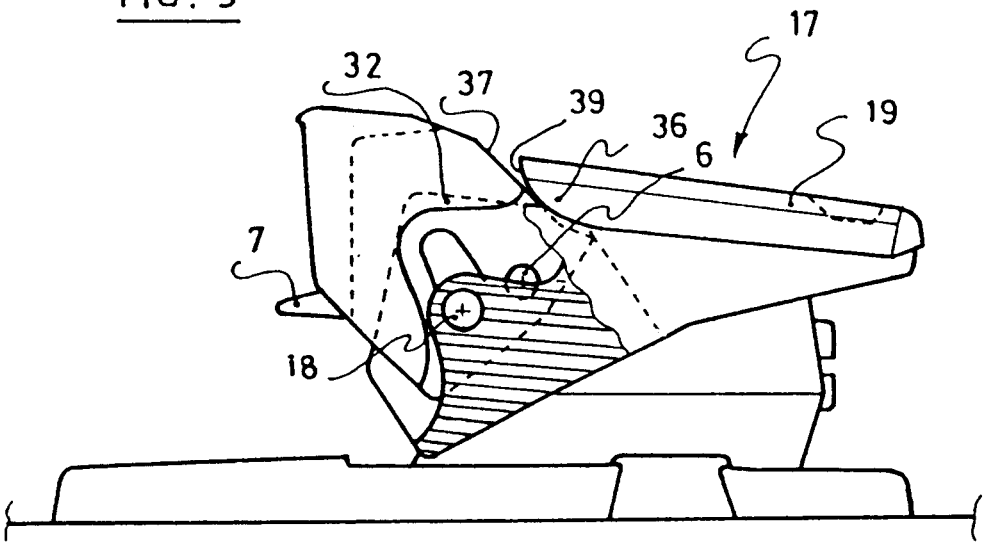
FIG. 5 is a side view of an alternative embodiment of the invention with respect to the lever.
Figure 6:
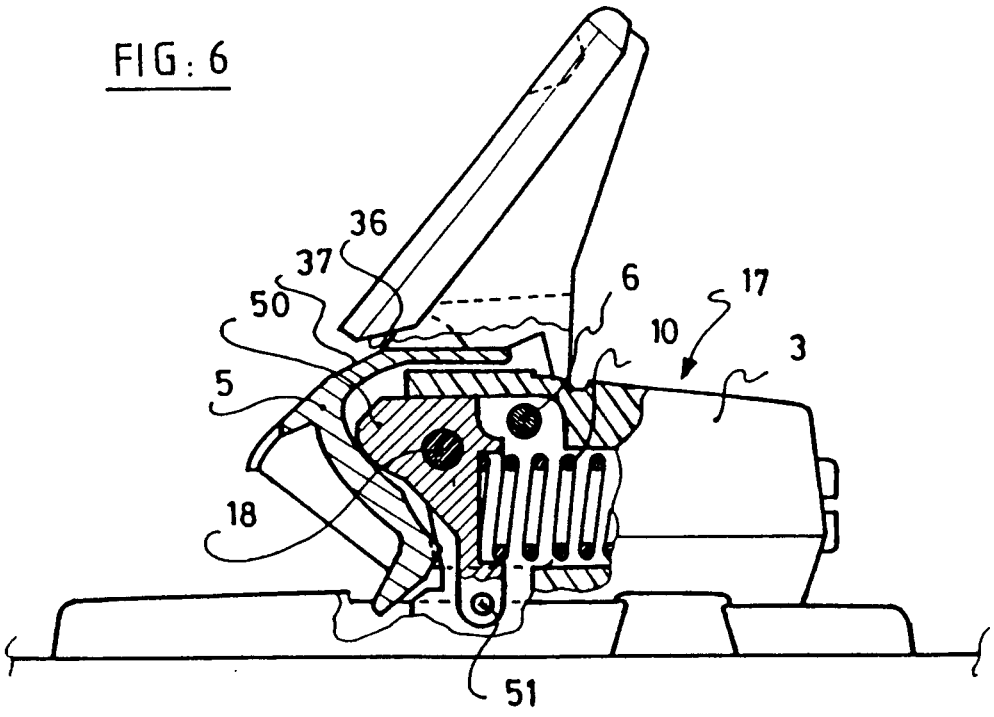
FIG. 6 is a side view of a further embodiment of the present invention with respect to the energization means.

Alternatively, as shown in FIG. 5, front edge 36 of jaw 5 may have curved surface 39. This curve surface permits simultaneously sliding and rolling engagement of edge 36 on upper surface 37 whereby lever moves jaw 5 towards its closed position with less exertion imposed on the user. FIG. 6 illustrates an alternative embodiment of the invention according to which the elastic return apparatus of the jaw, instead of being a slidable piston, has pivotal pressure element in the form of rocker 50 journalled around axis 51 fixed to body 3, and energized by spring 10. In this alternative embodiment, axis 18 of the lever 17 is carried by rocker 50. As a consequence, axis 18 is articulated, not for a longitudinal sliding movement, but for rotational movement about axis 51 of rocker 50. However, this alternative does not significantly modify the nature and operation of the first and second means of the lever and of the jaw as described in connection with FIGS. 1-5.

Figure 7:
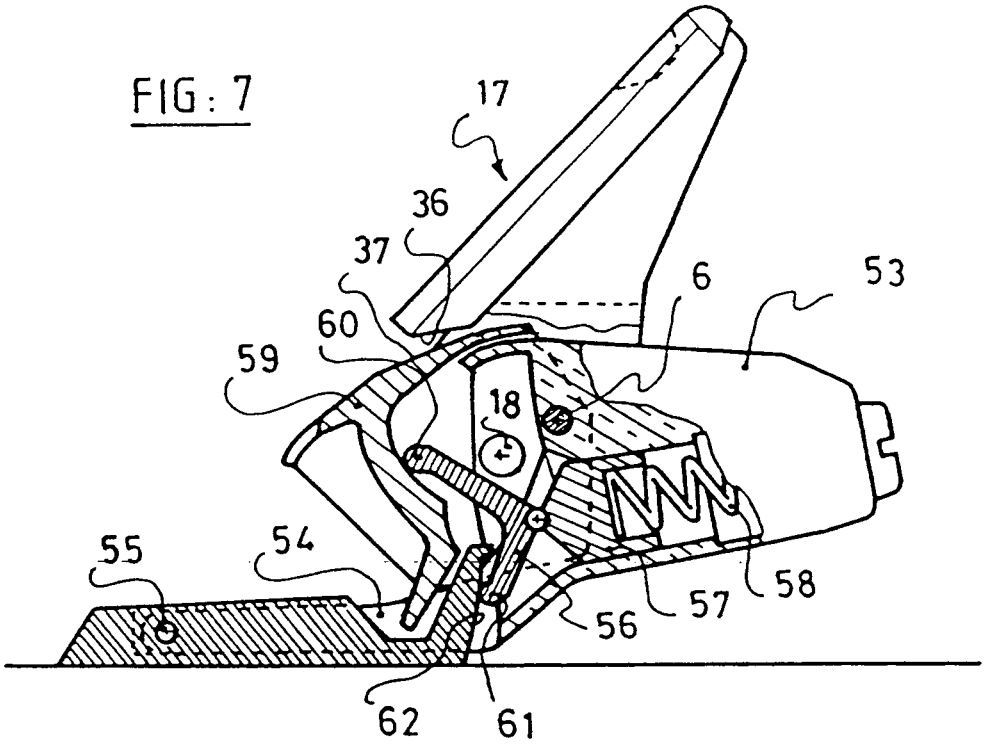
FIG. 7 is a side view of a further embodiment of the invention with respect to the energization means.

In the alternative embodiment shown in FIG. 7, body 53 is carried by arms 54 which are journalled on the ski for pivotal movement about transverse axis 55. Furthermore, the pressure element is constituted by bell crank 56 which is mounted by its apex at the end of piston 57 which is itself energized by spring 58.

Upper end 60 of bell crank 56 engages a ramp on jaw 59 which is similar to jaw 5 previously described. The other end 61 of the bell crank engages ramp 62 which is rigidly fixed to the ski. Binding such as this is disclosed in French Patent Application No. 86/10236 assigned to the assignee of the present application, and the disclosure which is hereby incorporated by reference.

This variation in structure has no significant effect on the nature and cooperation of the first and second means of lever 17 and jaw 5 as described above. FIG. 8, lever 17 is journalled rotationally about axis 70 carried by the body itself, not by the piston or rocker. The second means of the jaw and of the lever in this embodiment are similar to those means previously described.

Figure 10:
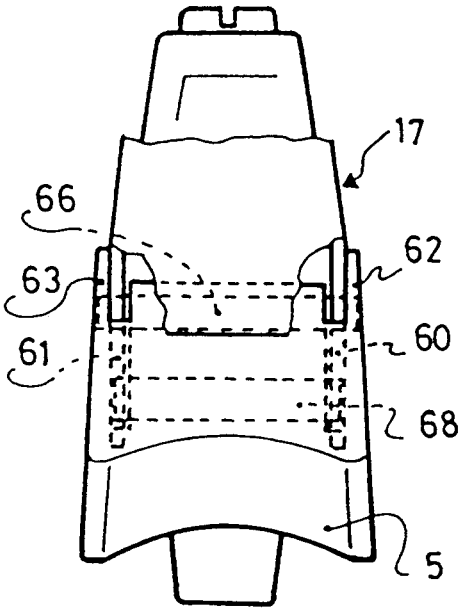
FIG. 10 is a top view of an alternative embodiment with respect to the relative position between the jaw and the lever.

FIG. 10 is an alternative embodiment of FIG. 9 which lateral cheeks 62 and 63 of jaw 5 are positioned on exterior cheeks 60 and 61 of lever 17. The principle difference between the present embodiment and the embodiments previously described is that journal axis 66 of jaw 5 extends through lateral cheeks 60 and 61 of lever 17, and that lateral cheeks 60 and 61 have, to this end, a slot which is generally dimensioned for the passage of the pin defining axis 66. The pin defining this axis is carried by the pressure element, and is positioned between cheeks 62 and 63 of jaw 5 without extending through its cheeks.

Although the present invention has been given with reference to particular means, materials and embodiments, it should be understood that the invention is not limited to the particular disclosed and extensive to all equivalents within the scope of the pending claims.

I claim:

1. A safety ski binding for retaining the end of a boot to a ski until a threshold bias force is exerted, said binding comprising:

(a) a body for connection to the ski;

(b) a jaw mounted on the front of the body for movement between a stable closed position at which the jaw is adapted to engage and retain the end of the boot when the latter is resting on the ski, and a stable open position at which the jaw is adapted to either free the end of the boot from the binding or to receive said end into the binding;

(c) elastic return apparatus for biasing the jaw towards one or the other of its stable positions, said apparatus including energization means and a pressure element;

(d) said jaw having a ramp that includes and elastic extend segment and an opening segment selectively engageable with said pressure element, engagement of the pressure element with the elastic extend segment of the ramp effecting movement of said jaw toward its closed position, and engagement of the pressure element with the opening segment of the ramp effecting movement of the jaw toward its opened position;

(e) a lever having a handle pivotally mounted on said binding and having a raised position rising above the body towards the rear thereof when the jaw is in its closed position, the handle being extended in a lowered position when the jaw is in its opened position, said handle having a front end defined by a front edge and two parallel cheeks which overly the rear portion of the jaw;

(f) first means on the lever cooperable with first means on the jaw for opening the latter, and second closure means on the lever cooperable with second means on the jaw for closing the latter;

(g) said second means of the lever being constituted by at least one portion of the front edge of the handle, and the second means of the jaw being constituted by at least a portion of the upper surface of the jaw;

(h) the second means of the lever and the second means of the jaw being constructed and arranged so that, when the jaw is in its opened position and the lever is in its lowered position, the front edge of the lever engages a portion of the upper surface of the jaw, and movement of the lever towards its raised position causes the front edge of the lever to move on a portion of said upper surface while moving the jaw toward its closed position, at least until the pressure element has reached the elastic extent segment.

2. A safety ski binding according to claim 1 wherein said front edge is beveled defining a planar surface that is substantially parallel to said portion on the upper surface of the jaw when the latter is in its opened position, and the lever is in its lowered position.

3. A safety ski binding according to claim 2 wherein said beveled edge makes an angle between about 30°–45° with the horizontal when the lever is in its lowered position.

4. A safety ski binding according to claim 3 wherein the angle of the beveled edge relative to the horizontal is about 37°.

5. A safety ski binding according to claim 1 wherein said front edge is curved.

6. A safety ski binding according to claim 5 wherein said portion on the upper surface of the jaw is planar.

7. A safety ski binding according to claim 1 wherein said portion on the upper surface of the jaw is curved.

8. A safety ski binding for retaining the end of a boot to a ski until a threshold bias force is exerted, said binding comprising:

(a) a body for connection to the ski;

(b) a jaw mounted on the front of the body for movement between a closed position at which the jaw is adapted to engage and retain the end of the boot to the ski, and an opened position at which the jaw is adapted to either free the end of the boot or to receive the end of the boot into the binding;

(c) elastic return apparatus having a single elastic member and constructed and arranged so as to resiliently maintain the jaw in each of its closed and opened positions;

(d) a manually operable lever having a handle mounted on said body for movement between closed and opened positions;

(e) first cooperable means on the handle and on the jaw for moving the jaw to its opened position in response to movement of the handle from its closed to its opened position; and (f) second cooperable means on the handle and on the jaw for moving the jaw to its closed position in response to movement from the handle from its opened to its closed position;

(g) said second cooperable means including a front edge on the handle engageable with a portion of the upper surface of the jaw.

9. 14. A safety ski binding according to claim 8 wherein said front edge defines a curved surface.

10. A safety ski binding according to claim 9 wherein said curved surface is convex.

11. A safety ski binding according to claim 8 wherein said portion of the upper surface is curved.

12. A safety ski binding according to claim 8 wherein said handle is U-shaped in transverse cross-section and includes spaced parallel cheeks that overlie said jaw, and a connection between said cheeks defining said front edge.

13. A safety ski binding according to claim 12 wherein said front edge defines a planar surface.

14. A safety ski binding according to claim 12 wherein said front edge defines a curved surface.

15. A safety ski binding for retaining the end of a boot to a ski until a threshold bias force is exerted, said binding comprising:

(a) a body for connection to the ski;

(b) a jaw mounted on the front of the body for movement between a closed position at which the jaw is adapted to engage and retain the end of the boot to the ski, and an opened position at which the jaw is adapted to either free the end of the boot or to receive the end of the boot into the binding;

(c) elastic return apparatus constructed and arranged so as to resiliently maintain the jaw in either its closed or open position;

(d) a manually operable lever having a handle mounted on said body for movement between closed and opened position;

(e) first cooperable means on the handle and on the jaw for moving the jaw to its opened position in response to movement of the handle from its closed to its opened position;

(f) second cooperable means on the handle and on the jaw for moving the jaw to its closed position in response to movement from the handle from its opened to its closed position;

(g) said second cooperable means including a front edge on the handle engageable with a portion of the upper surface of the jaw; and (h) wherein said front edge defines a planar surface that engages said portion of the upper surface of the jaw when the handle is in its opened position.

16. A safety ski binding according to claim 15 wherein said portion of the upper surface is planar and engages the planar surface of the front edge of the handle when the latter is in its opened position.

17. A safety ski binding according to claim 16 wherein substantially all of the planar surface on the handle engages the planar surface on the upper portion of the jaw when the handle and the jaw are in their opened position.

18. A safety ski binding according to claim 15 wherein said planar surface makes an angle between about 30°–45° with a horizontal when the handle is in its opened position.

19. A safety ski binding according to claim 18 wherein said angle is about 37°.

20. A safety ski binding according to claim 15 wherein said portion of the upper surface is curved.

21. A safety ski binding for retaining the end of a boot to a ski until a threshold bias fore is exerted, said binding comprising:

(a) a body for connection to the ski;

(b) a jaw mounted on the front of the body for movement between a closed position at which the jaw is adapted to engage and retain the end of the boot to the ski, and an opened position at which the jaw is adapted to either free the end of the boot or to receive the end of the boot into the binding;

(c) elastic return apparatus having a single elastic member and constructed and arranged so as to resiliently maintain the jaw in either its closed or open position; and (d) a manually operable lever having a handle mounted on said body for movement between closed and opened positions, said lever having means cooperable with said jaw for moving said jaw to either of its closed or opened positions in response to manual movement of said lever to either of its closed or opened positions respectively.

22. A binding according to claim 21 including:

(a) cooperable means on the handle and on the jaw for moving the jaw to its closed position in response to movement from the handle from its opened to its closed position;

(b) said second cooperable means including a front edge on the handle engageable with a portion of the upper surface of the jaw.

23. A safety ski binding for retaining the end of a boot to a ski until a threshold bias force is exerted, said binding comprising:

(a) a body for connection to the ski;

(b) a jaw mounted on the front of the body for movement between a closed position at which the jaw is adapted to engage and retain the end of the boot to the ski, and an opened position at which the jaw is adapted to either free the end of the boot or to receive the end of the boot into the binding;

(c) elastic return apparatus constructed and arranged to as to resiliently maintain the jaw in either its closed or open position; and (d) a manually operable lever having a handle mounted on said body for movement between closed and opened position;

(e) cooperable means on the handle and on the jaw for moving the jaw to its opened position in response to movement from the handle from its closed to its opened position;

(f) said second cooperable means including cooperating pin means in the jaw and handle.

* * * * *

UNITED STATES PATENT AND TRADEMARK OFFICE

CERTIFICATE OF CORRECTION

PATENT NO. : 5,005,854

DATED : April 9, 1991

INVENTOR(S) : Pierre SZAFRANSKI

It is certified that error appears in the above-identified patent and that said Letters Patent is hereby corrected as shown below:

At column 1, line 29, delete "5".
At column 2, line 64, change "if" to ---in---.
At column 3, line 45, change "overly" to ---overlie---.
At column 6, line 12, change "pivot s" to ---pivots---.
At column 7, line 32 (claim 1, line 16), change "and" to ---an---.
At column 7, line 33 (claim 1, line 17), change "extend" to ---extent---.
At column 7, line 47 (claim 1, line 31), change "overly" to ---overlie---.
At column 8, line 47 (claim 9, line 1), delete "14".
At column 9, line 42 (claim 21, line 2), change "fore" to ---force---.
At column 10, line 35 (claim 23, line 12), change "to" (first occurrence) to ---so---.

Signed and Sealed this

Fifth Day of October, 1993

Bruce Lehman

*Attest:*

BRUCE LEHMAN

*Attesting Officer*

*Commissioner of Patents and Trademarks*